United States Patent [19]

Kissel

[11] 4,048,964

[45] Sept. 20, 1977

[54] FUEL METERING APPARATUS AND METHOD

[75] Inventor: William Ronald Kissel, Milford, Mich.

[73] Assignee: Chrysler Corporation, Highland Park, Mich.

[21] Appl. No.: 599,243

[22] Filed: July 24, 1975

[51] Int. Cl.[2] ..... F02B 3/00; F02M 39/00

[52] U.S. Cl. ..... 123/32 ED; 123/139 E; 123/32 EA; 137/101.19

[58] Field of Search ..... 123/32 EA, 179 G, 179 C, 123/139 E, 119 R; 137/98, 100, 101.19; 60/39.28; 431/90

[56] References Cited

U.S. PATENT DOCUMENTS

| | | | |
|---|---|---|---|
| 3,128,603 | 4/1964 | Haigh | 123/32 EA |
| 3,796,197 | 1/1974 | Locher | 123/32 EA |
| 3,796,199 | 3/1974 | Knapp | 123/32 EA |
| 3,817,225 | 6/1974 | Priegel | 123/32 EA |
| 3,818,877 | 6/1974 | Barrera | 123/32 EA |
| 3,831,563 | 8/1974 | Brittain | 123/32 EA |
| 3,933,135 | 1/1976 | Zillman | 123/32 EA |
| 3,935,851 | 2/1976 | Wright | 123/32 EA |
| 3,949,714 | 4/1976 | Mitchell | 123/32 EA |

*Primary Examiner*—Carroll B. Dority, Jr.
*Assistant Examiner*—Ronald B. Cox
*Attorney, Agent, or Firm*—Talburtt & Baldwin

[57] ABSTRACT

A closed loop, electronically controlled and regulated fuel metering system for operating an internal combustion engine in accordance with a predetermined mass fuel-air ratio scheduled in the controller for different engine operating conditions. Linear air flow and fuel flow measuring devices and transducers responsive to selected ambient fluid and engine operating parameters develop electrical signals, which are related to the air flow rate and fuel flow rate and are modified in accordance with the sensed ambient parameters and a programmed signal from the scheduler representing the fuel-air ratio according to which it is desired to operate the engine over its range of operation. The modified fuel and air signals are electrically combined to balance the controller which operates a fuel metering or supply device to deliver a quantum of fuel precisely in accordance with the desired mass fuel-air ratio scheduled in the controller for said different engine operating conditions over the entire range of engine operation and ambient fluid parameter variations.

47 Claims, 17 Drawing Figures

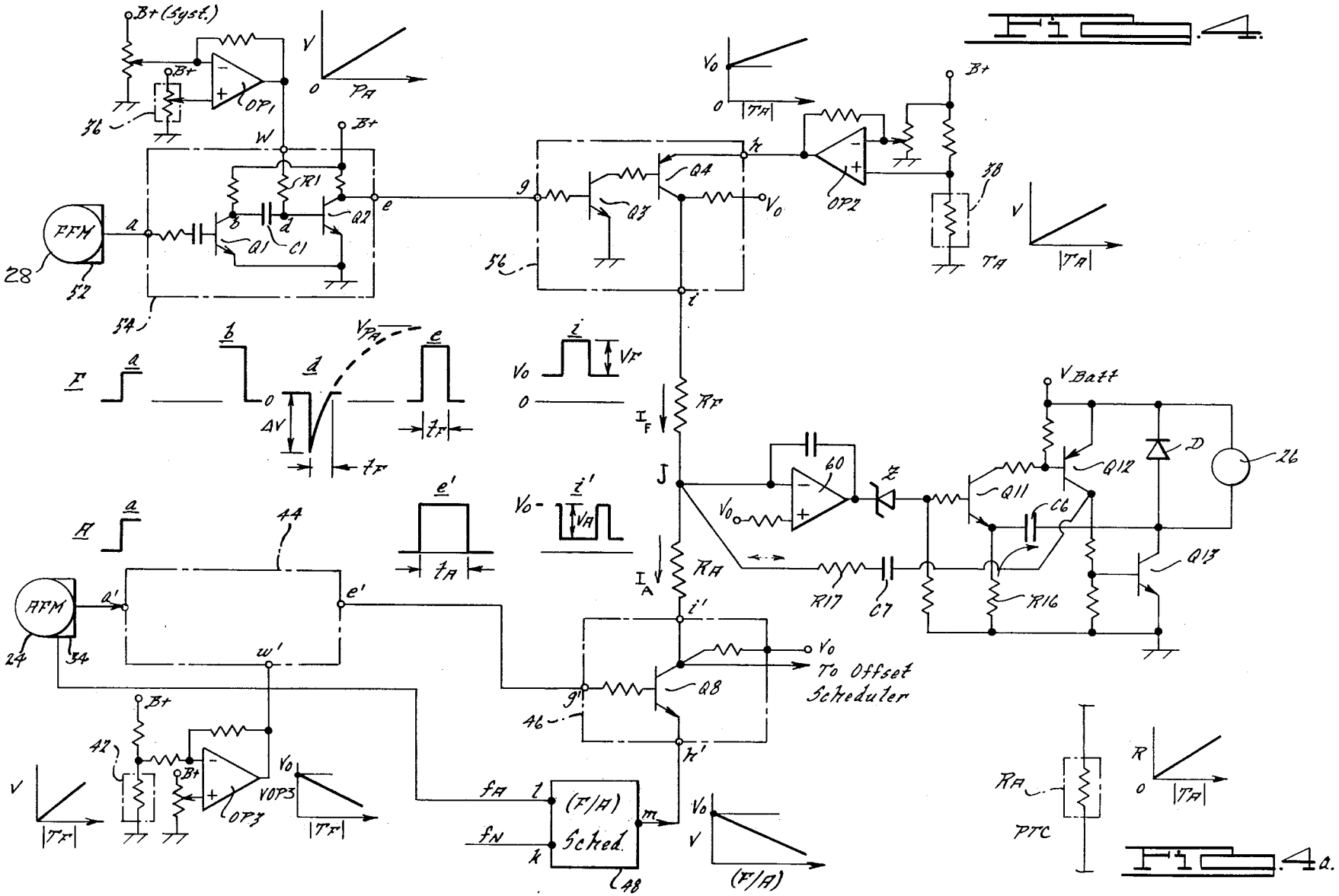
To Offset Scheduler
(F/A) Sched.
Batt
Syst.
OPA
FFM
PTC

FUEL METERING APPARATUS AND METHOD

BACKGROUND OF THE INVENTION

This invention relates to fuel metering systems for controlling the mass ratio of fuel and air supplied to an internal combustion engine and seeks generally to provide improvements in such systems of the general character shown in U.S. Pat. No. 3,817,225 and U.S. Pat. application Ser. No. 428,261 filed Dec. 26, 1973, now U.S. Pat. No. 3,935,851.

In such prior forms of fuel metering system or apparatus, the metering and programming functions are so combined and implemented that the mass flow corrections to the fuel and air signals for ambient fluid density parameter variations are accurate for only one value or limited range of variation of the desired fuel-air ratio schedule or the latter may be accurate for only one set or a limited range of variation of the ambient fluid conditions, so that the systems do not satisfy the desired fuel-air metering relation over the entire range of engine operation and ambient conditions.

The present invention seeks to provide a fuel metering system in which the fuel metering and programming functions are distinct and are implemented in a manner such that the actual mass fuel-air ratio is accurately and precisely controlled and maintained in accordance with a predetermined desired fuel metering relation over the entire range of engine operation and ambient fluid parameter variations.

Related objects are to provide a fuel metering system which is designed and operated in such a manner as to provide greater accuracy, precision and flexibility over known prior systems while affording simplification and reduction in the cost of implementation thereof.

Other objects are to provide a fuel metering system which is suitable for mass production, large scale use on automotive vehicle engines and improves the performance, fuel consumption and emissions levels of internal combustion engines in such vehicles.

SUMMARY OF THE INVENTION

Towards the accomplishment of the above and other objects, there is provided in accordance with the present invention a closed loop regulated, fuel metering system for maintaining a scheduled mass fuel-air ratio in an internal combustion engine. The system employs air flow and fuel flow measuring devices providing pulsatory electrical signals whose pulse repetition rates vary with the volumetric flow rates of the respective fluids and whose pulse amplitude and/or pulse width or duty cycle characteristics are varied or modulated by selected ambient fluid parameters and a predetermined mass fuel-air ratio schedule. The signals, which may be of opposite polarity, are electrically combined in an integrator whose output is balanced when the modified air and fuel signals have a predetermined relationship to each other such that the actual mass fuel-air ratio will correspond to the desired fuel-air ratio over the entire range of engine operation, ambient parameters and scheduled fuel-air ratios. The output of the integrator is applied through a variable duty cycle power conservation circuit to a variable speed electrically driven pump. The latter supplies a quantum of fuel accurately and precisely proportioned to the mass flow rate of air entering the engine in accordance with the desired mass fuel-air ratio scheduled in the controller for said different engine operating conditions over the entire range of engine operation and ambient parameters which affect the mass flow rate of the two fluids supplied to the combustion engine.

DESCRIPTION OF THE DRAWINGS

In the Drawings:

FIG. 3 is a block diagram of a fuel metering system according to the present invention including the transfer characteristics of the pulse width and amplitude controllers employed therein for the particular control or modulating signal sources applied thereto and their effect on the fuel and air pulse signals in the respective signal channels;

FIG. 4 illustrates schematic electrical circuits for various ones of the components employed in the fuel metering system of FIG. 3 including wave forms at different points in the circuits and the transfer characteristics of the several control or modulating sources and their associated transducers;

FIG. 4A is a modification to the circuit shown in FIG. 4 in accordance with another embodiment of the invention;

DETAILED DESCRIPTION

Figure 1:
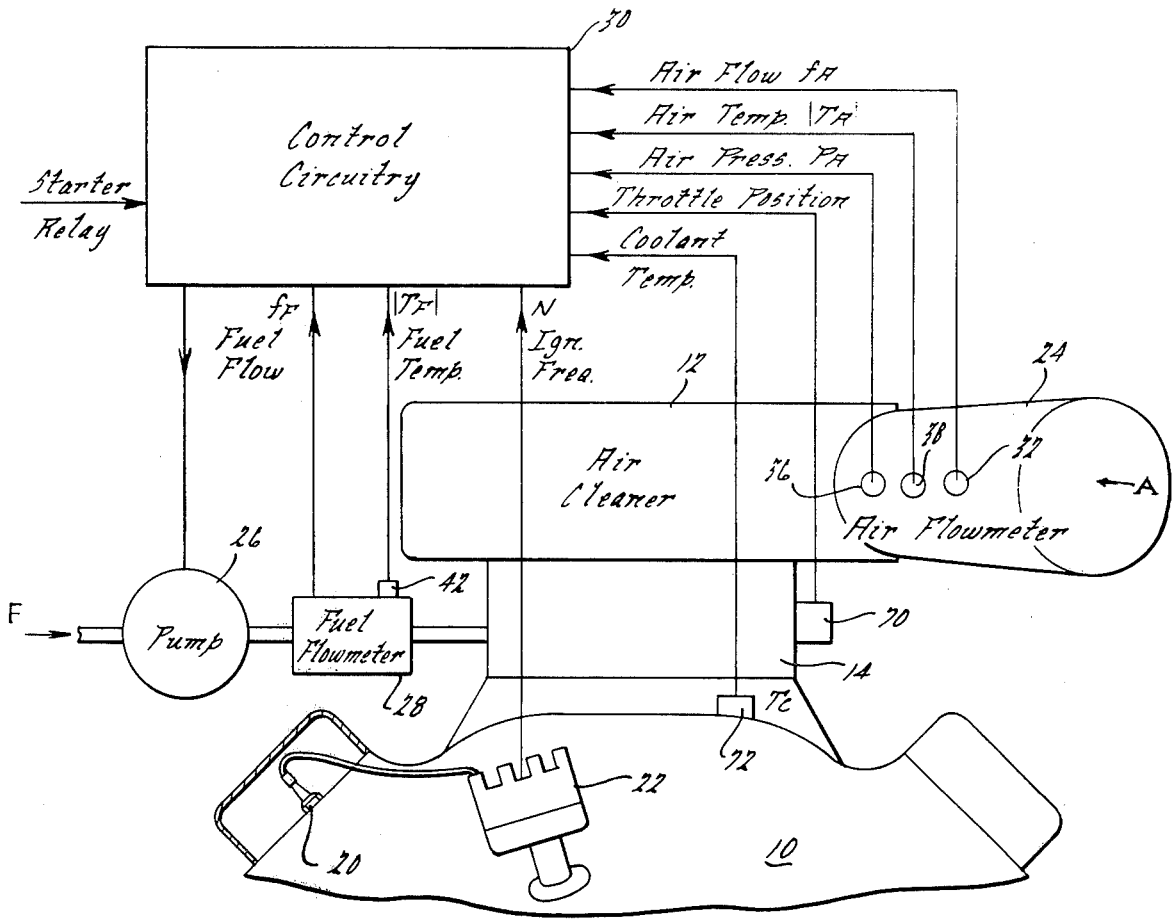
FIG. 1 illustrates the several components and controls of a closed loop, electronically controlled and regulated fuel metering system in accordance with the invention for an internal combustion engine.

FIG. 1 illustrates an internal combustion engine 10 for a motor vehicle equipped with an air cleaner 12 in which air received from outside the engine is transferred through the throttle body 14 for combustion with a quantity of fuel, which is supplied from a fuel reservoir (not shown) carried by the vehicle. The fuel is injected into the throttle body where it is suitably mixed or carbureted with the air entering the engine, and the gaseous fuel-air mixture, supplied through the throttle body, is ducted to the engine combustion chambers, each of which contains a spark plug 20 to which high tension electrical energy from the ignition coil (not shown) is selectively applied through the engine-driven, ignition distributor device 22.

In the fuel metering system described herein, fuel is supplied to the engine in direct response to and as a function of the amount of air entering the engine as sensed by an air flowmeter measuring device 24, the fuel being delivered to the throttle body by an electrically operated fuel controller or metering device 26, such as a variable speed electrically driven pump, through a fuel flowmeter measuring device 28. The amount of fuel supplied to the engine is continuously controlled and regulated in a closed loop feedback control system by an electronic controller 30, which receives the air flow and fuel flow signals measured by the fluid flowmeters and combines them in a manner to cause the fuel delivered by the pump and as sensed by the fuel flowmeter to correspond with a desired mass fuel-air ratio for the engine as scheduled in the controller.

Figure 2A:
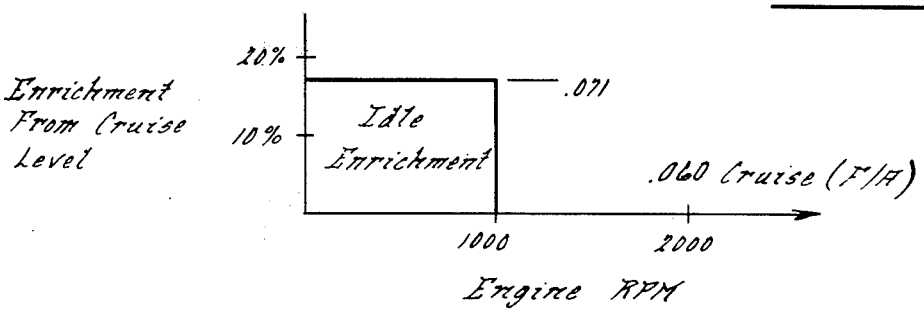
FIGS. 2A and 2B are graphical plots of desired fuel air ratios for different engine operating speed and load conditions or parameters.
Figure 2B:
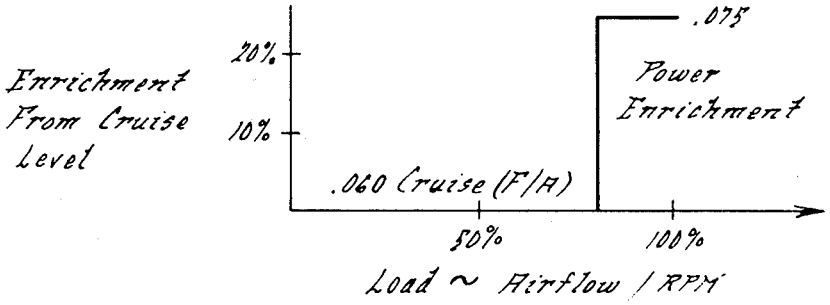
Figure 2:
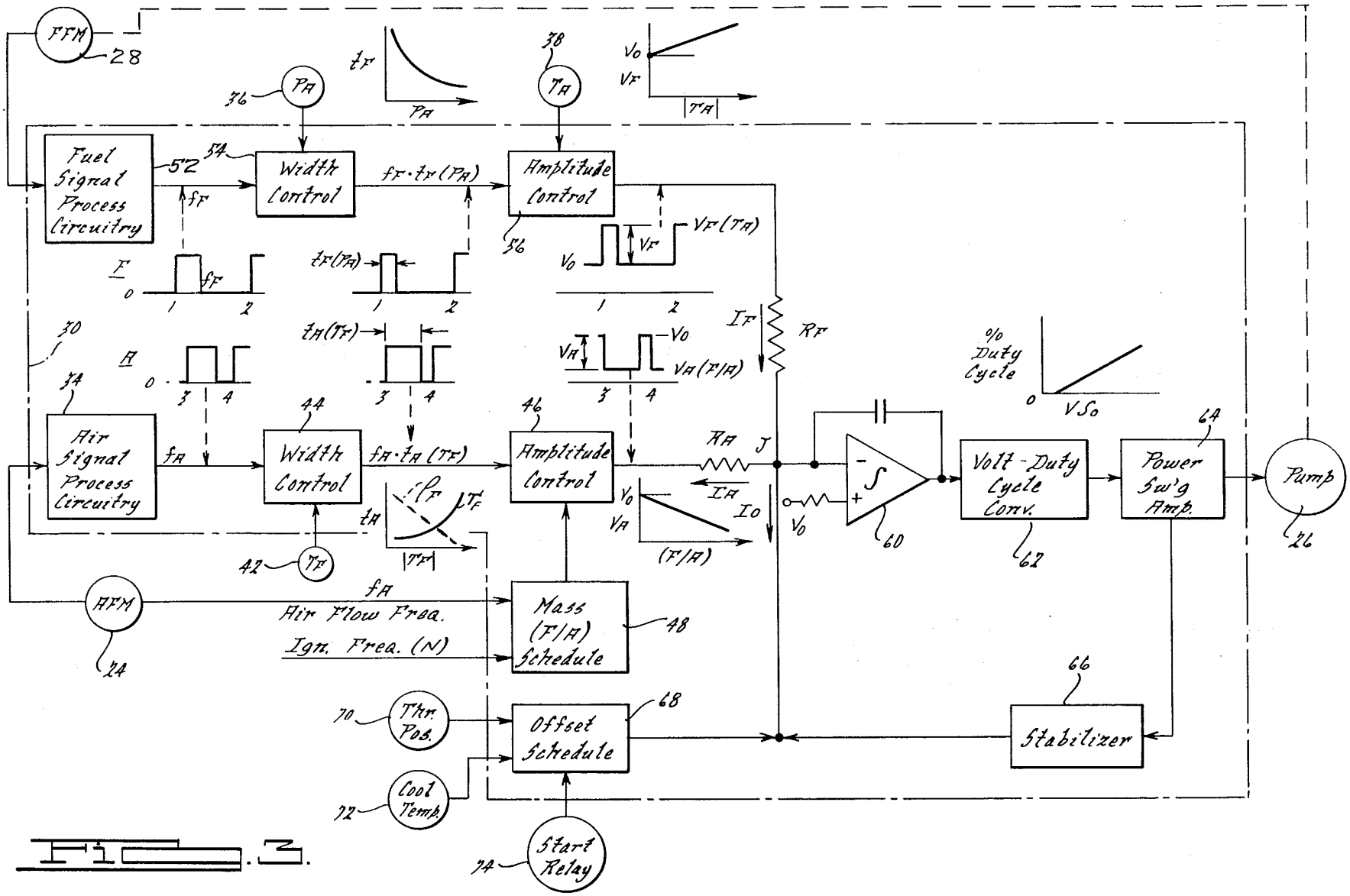

FIGS. 2A and 2B are graphical plots showing desired mass fuel-air ratios for different engine operating speed and load conditions or parameters and illustrate the different ratios selected for the idle, cruise and power operating modes of which the idle and power modes require different and enriched ratios over the ratio required for the cruise level. In the embodiment of the invention described herein, the fuel-air ratios are selected to be 0.071 in the depicted idle enrichment mode, 0.060 in cruise and 0.075 in the power enrichment mode. Additional enrichments are further provided during engine starting, cold engine operation and vehicle acceleration conditions as later described herein.

The air flow measuring device 24 may be a vortex-type flow-meter positioned in the intake snorkel of the engine air cleaner 12 and employs a sensor probe 32 for generating or developing an electrical signal having a characteristic which varies with the volumetric air flow rate. The air flow sensor probe may be of the type shown in U.S. Pat. No. 3,830,104 of common ownership herewith and comprises a temperature dependent resistance or thermistor element, which is connected in a self-excited, feedback amplifier regulated bridge circuit of the type shown in U.S. Pat. application Ser. No. 469,933, filed May 14, 1974, now U.S. Pat. No. 3,995,482 of common ownership herewith. The bridge circuit is included in signal amplifier processing circuitry 34 in the controller 30 and provides a substantially rectangular-shaped pulsatory electrical output signal whose frequency or pulse repetition rate $f_A$ is directly proportional to the volumetric rate of air flow through the flowmeter. Because it is the mass fuel-air ratio which is controlled and, since the air flowmeter is a volumetric measuring device, a barometric pressure transducer 36 and an air temperature sensor 38, both located in the inlet of the air cleaner adjacent the air flowmeter 24, are employed to sense the air surrounding the engine and provide air density information, which is used to modify the volumetric flow information in accordance with the sensed air density parameters.

The fuel flow measuring device 28 may be a paddle-wheel flowmeter of the type discussed in U.S. Pat. No. 3,814,935 of common ownership herewith and includes a photo-electric transducer, which senses the rotational displacement of the paddlewheel, and associated signal processing circuitry 52, which may be located in the electronic controller 30, to develop a substantially rectangular-shaped pulsatory electrical signal whose frequency $f_F$ or pulse repetition rate characteristic is proportional to the volumetric rate of fuel flow. Since the fuel density $\rho_F$ is almost completely a function of the fuel temperature $T_F$, a fuel temperature sensor 42, shown physically located in the fuel flowmeter 28, is employed to modify the volumetric flow information in accordance with the sensed fuel density information for a form of volumetric to mass rate of flow correction or conversion in one or the other of the fuel signal or air signal channels.

As depicted in the FIG. 3 embodiment of the invention, the air flow measuring channel of the fuel metering system includes the air flowmeter 24 and associated signal processing circuitry 34, whose pulsatory output signal A is applied through an air pulse width controller 44 and an air pulse amplitude controller 46 to a resistor $R_A$. The air pulse width controller 44 controls the duty cycle or period $t_A$ of the air pulse signal as a function of the fuel temperature $T_F$ and in a manner such that the width of the air pulse signal increases with an increase in fuel temperature as shown by the $t_A - T_F$ transfer characteristic of the air pulse width controller.

The air pulse amplitude controller 46 controls the amplitude $V_A$ of the air pulse signal as a function of the desired steady-state mass fuel-air ratio (F/A) and in a manner such that the amplitude of the air pulse signal, as measured from a fixed reference voltage level, increases in one direction with an increase in the scheduled F/A ratio, as shown by the $V_A$ - (F/A) transfer characteristic of the air pulse amplitude controller. The (F/A) factor or parameter is provided by a mass fuel-air scheduler 48, which is contained within the controller 30 and provides a fuel-air ratio representative output voltage signal from an air flow or engine load representative input signal and/or an engine speed representative input signal, which are respectively derived and applied thereto from the air flow meter 24 and the ignition distributor 22, as more fully described later herein.

The fuel flow measuring channel includes the fuel flowmeter 28 and associated signal processing circuitry 52 whose pulsatory output signal F is applied through a fuel 52 width controller 54 and a fuel pulse amplitude controller 56 to a resistor $R_F$. The pulse width controller 54 controls the duty cycle or period $t_F$ of the fuel pulse signal from the fuel flowmeter and associated circuitry 40 as a function of barometric pressure $P_A$ and in a manner such that the width $t_F$ of the fuel pulse signal decreases with an increase in barometric pressure, as shown by the $t_F - P_A$ transfer characteristic of the fuel pulse width controller in the FIG. 3 embodiment of the invention.

The fuel pulse amplitude controller 56 controls the height or amplitude $V_F$ of the fuel pulse signal as a function of absolute ambient air temperature $T_A$ and in a manner such that the pulse height amplitude of the fuel pulse signal, as measured from a fixed reference voltage level, increases with increasing air temperature and in a direction opposite to the direction of increase of the amplitude of the air pulse signal, as shown by the $V_F - T_A$ transfer characteristic of the fuel pulse amplitude controller in FIG. 3.

The output signals from the air flow and fuel flow channels are of opposite polarity relative to the $V_o$ reference and are electrically combined at the junction of the summing resistors $R_F$ and $R_A$ of an integrator 60 forming part of the fuel metering channel or portion of the system. The integrator is balanced when the air flow and fuel flow signals have a predetermined relationship according to a defined fuel metering equation and provides an output voltage therefrom of a magnitude or level as to drive the variable speed motor pump 26 at a rate such that the actual amount of fuel delivered thereby and sensed by the fuel flowmeter will correspond to the amount of fuel required to maintain the desired fuel-air ratio scheduled in the controller.

A change in the flow rate of either fluid or in any of the sensed ambient parameters $T_A$, $P_A$ or $T_F$, which affects the density $\rho$ and, therefore, the actual mass flow of one or the other of the fluids supplied to the engine, unbalances the integrator and changes its output by an amount and in a direction to change the fuel delivered by the pump until the amount of fuel as sensed by the fuel flowmeter causes the fuel signal to rebalance the integrator and thus maintain the actual mass fuel-air ratio in correspondence with the scheduled mass fuel-air ratio. A change in the output of the integrator corresponding to less than the desired fuel flow increases the drive to the pump to cause more fuel to flow and vice-versa.

The voltage output of the integrator is supplied as a control signal to the d.c. pump drive motor 26 through a variable duty-cycle pump drive or fuel controller control circuit, which is included in the fuel metering channel or portion of the system and comprises a voltage level to duty-cycle converter 62 and a power switching amplifier 64 and whose percent duty-cycle to input voltage level (or output voltage of the integrator) transfer characteristic is also shown in FIG. 3. The fuel controller circuit energizes the pump motor by applying full battery system voltage with variable duty-cycle drive which results in greatly reduced power dissipation in the driving transistors.

Due to the finite response times of the fuel pump and the fuel flowmeter, a stabilizing network 66 is employed between the output of the pump control circuitry and the input of the integrator to provide a form of derivative or rate feedback control for damping and preventing undesirable hunting of the pump, as would otherwise be encountered in the absence of the stabilizer.

An additional or offset fuel-air scheduler 68 is provided in the controller 30 to further modify the output of the integrator and cause more or less fuel to be supplied from the fuel supply device to account for different engine operating and vehicle driving conditions requiring enrichment of the fuel-air ratio such as may be necessary during vehicle acceleration, cold engine operation and engine starting conditions, for example. Input signals responsive to the position of the throttle blade in the throttle body as sensed by a linear throttle position transducer 70, engine coolant temperature $T_c$ as sensed by a linear temperature sensor transducer 72, and engine starting operation as sensed by, say, the condition of the engine starter relay 74 are applied to the offset scheduler 68 to provide a scaled output offset signal, which is supplied to or drawn from one of the input terminals of the integrator to modify the output thereof and cause additional fuel to be supplied to the engine.

The fuel pulse width controller 54 is shown schematically in FIG. 4 as a form of transistor one-shot or univibrator circuit, which is triggered into conduction by a trigger input signal for a period of time determined by the magnitude of another signal from a current source whose amplitude varies in accordance with barometric pressure $P_A$. The current source is approximated by a voltage source $V_{PA}$ and a resistor R1, shown connected internally of the univibrator to its pulse width control input terminal W. The trigger input terminal *a* of the univibrator is connected to receive the pulsatory fuel flowmeter signal F, and its pulse width control input terminal W is connected to receive a control voltage signal $V_{PA}$ which varies directly in accordance with the barometric pressure $P_A$. The latter parameter is sensed by the barometric pressure transducer 36, which is shown as a continuously variable linear resistance element connected to the electronic system voltage supply labelled B+. The adjustable take-off or output point of the barometric potentiometer device is applied to the non-inverting input of an operational amplifier OP1, which, like the other operational amplifiers used herein, may be of the commonly available $\mu$ A741 type. The output of the operational amplifier is a d.c. voltage signal whose amplitude will thus increase linearly with increasing barometric pressure $P_A$ as shown by the linear V - $P_A$ transfer characteristic in FIG. 4 of the voltage source $V_{PA}$ formed by the combination of the transducer 36 and operational amplifier OP1, and is applied to the pulse width or period control input W of the univibrator 54.

The electronic system supply voltage is derived by an inverter power supply (not shown) from the regulated vehicle battery and rectified alternator output voltage to furnish power to the operational amplifiers and various components of the fuel metering system at a B+ operating voltage level of 25.0 volts above signal ground or B− level, and to supply a reference voltage level $V_o$, which is one-half of B+ or +12.5 volts above ground.

The univibrator circuit 54 includes a pair of oppositely conducting, similar conductivity-type PNP transistors $Q_1$ and $Q_2$ and responds to the leading edge of the pulsatory flowmeter signal F applied to its trigger input terminal *a* to turn on the normally non-conducting input transistor $Q_1$, whose collector voltage immediately drops to nearly ground level as shown by waveform *b* in FIG. 4. The collector of $Q_1$ is connected to one side of a capacitor C1, which senses this sudden voltage drop and causes the voltage at the other side of the capacitor C1 to be displaced by an an amount $\Delta$ V or approximately B+ from the conduction level of the base emitter junction of the normally conducting output transistor $Q_2$, as shown at *d* in FIG. 4. The latter transistor then turns off and raises its collector voltage approximately to B+ as shown at *e* to commence the leading edge of the output pulse and the start of the conduction period of the univibrator.

The capacitor C1 commences to charge along the illustrated logarithmic charging curve through the resistor $R_1$ toward the voltage of the source $V_{PA}$ connected to the width control input terminal W and until the voltage at the side of the capacitor connected to the point *d* or the base of $Q_2$ attains a voltage to turn $Q_2$ back on again, terminating the univibrator conduction period. The width or period $t_F$ of the output pulse taken from output terminal *e* of the univibrator 54 will thus be seen to be inversely related to and to vary almost linearly with the amplitude of the voltage $V_{PA}$ applied to the pulse width control input terminal W and to be of generally decreasing width or duty-cycle with increasing barometric pressure as depicted by the non-linear $t_F$ - $P_A$ transfer characteristic of the fuel pulse width controller 54 in FIG. 3.

The fuel pulse amplitude controller 56 is a transistor pulse amplifier having an input terminal *g,* a pulse height control input terminal *h* and an output terminal *i.*

The amplifier is shown schematically in FIG. 4 as comprising a pair of normally nonconducting transistors $Q_3$ and $Q_4$, which are of opposite conductivity types and of which the first stage is an inverter stage. The NPN input transistor $Q_3$ is switched on by the output pulse from the pulse width controller 54 applied to its input terminal *g* to supply base current to the second stage PNP switching output transistor $Q_4$ whose collector is connected through a voltage droping resistor to the fixed reference voltage $V_o$. The emitter of $Q_4$ is connected to the pulse height control input terminal *h* to receive a control voltage, which is at $V_o$ when the air temperature is at absolute zero and varies linearly in accordance with absolute air temperature $T_A$ as sensed by the air temperature transducer 38. The latter may be a PTC linear resistance thermistor element connected in a fixed voltage divider arrangement to B+ with the voltage divider junction connected to the non-inverting input of an operational amplifier OP2. The output voltage of the amplifier will be offset by $V_o$ and will vary linearly and increase directly with increasing absolute air temperature $T_A$ as depicted by the linear $V - T_A$ transfer characteristic in FIG. 4 of the air pulse amplitude control voltage source $V_{TA}$ comprised of the air temperature transducer and associated offset and operational amplifier circuitry.

The output of the fuel pulse amplitude controller 56 is taken from the collector of $Q_4$, the voltage level of which will be at $V_o$ when $Q_4$ is off and will increase therefrom by an amount $V_F = V_F(T_A) - V_o$ in accordance with the absolute air temperature when transistor $Q_4$ is switched on. The output of the fuel pulse amplitude controller thus appears as a train of voltage pulses of a frequency or pulse repetition rate $f_F$, which is a function of the volumetric fuel flow rate, and having a pulse width or period $t_F$, which is a function of barometric pressure $P_A$, and a pulse amplitude $V_F$, as represented by the wave forms shown in FIG. 3 and is applied through a resistor $R_F$ to develop the fuel current signal $I_F$.

The air pulse width controller 44 is also an astable multivibrator or one-shot univibrator of similar circuit configuration to the fuel pulse width controller 54 shown in FIG. 4 and has its trigger input terminal *a'* connected to receive the pulsatory output signal A from the air flowmeter 24. Its period or pulse width controlling input W' is connected to receive a control voltage signal $VT_F$, which is responsive to and varies linearly as a function of absolute fuel temperature, $T_F$, as sensed by a PTC linear resistance thermistor element 42. The latter element is shown connected in a fixed voltage divider arrangement to the system B+ voltage level with the divider junction connected to the inverting input of an operational amplifier OP3, whose output voltage will thus vary in inverse linear fashion with absolute fuel temperature $T_F$ as shown by the $V_{op3} - T_F$ transfer characteristic of the combination of the fuel transducer and operational amplifier representing the control voltage source $V_{TF}$ in FIG. 4.

Since the pulse width control transfer function or characteristic of the one-shot pulse width controller causes the pulse width of the output pulse taken from the output terminal *e'* of the univibrator 44 to vary inversely with the amplitude of the control voltage $VT_F$ applied to its pulse width control input W', and since the amplitude of the latter voltage varies inversely with the fuel temperature $T_F$, the period $t_A$ or width of the air pulse signal at the output *e'* of the air pulse width controller 44 will vary non-linearly and will increase with increasing fuel temperature as shown by the $t_A - T_F$ transfer characteristic in FIG. 3.

The air pulse amplitude controller 46 is generally similar to the fuel pulse amplitude controller 56, except that it omits the inverter input stage and employs a transistor $Q_8$ which is of the opposite conductivity type to its corresponding transistor $Q_4$ of the fuel pulse amplitude controller, whereby the signals from the air pulse channel will be of opposite polarity or oppositely phased to the signals from the fuel pulse channel. The amplitude of the air pulse signals applied to the input terminal *g'* of the air pulse height controller 46 from the output terminal *e'* of the air pulse width controller 44 is modulated or varied in accordance with a control voltage which varies as a function of the scheduled mass F/A ratio from the mass F/A scheduler 48 and is applied to the pulse height control input terminal *h'* connected to the emitter of output transistor $Q_8$. The F/A scheduler provides a scaled output voltage, which decreases with increasing mass F/A ratio as shown by the $V_{48}$ - F/A transfer characteristic of the scheduler 48 in FIG. 4.

The collector of $Q_8$ is connected to the reference voltage source $V_o$ through a dropping resistor and is at the 12.5V level of $V_o$ when $Q_8$ is non-conducting. When $Q_8$ is switched on, its collector voltage drops by an amount $V_A$ to the level of the control voltage from the scheduler 48, so that the amplitude $V_A$ of the resulting air pulse signal from the output of the air pulse amplitude controller will be equal to $V_o - V_{(F/A)}$ and will vary linearly with the F/A ratio as shown by the $V_A$ - F/A transfer characteristic of the air pulse amplitude controller. The output of the latter appears as a train of voltage pulses of a frequency or pulse repetition rate $f_A$, which is a function of the volumetric air flow rate, and having a pulse width or period $t_A$ which is a function of absolute $T_F$, and having a pulse amplitude $V_A$, as represented by the waveforms in FIG. 3 and is applied through a resistor $R_A$ to develop the air current signal $I_A$.

The fuel current signal $I_F$ and the air current signal $I_A$ are applied to the integrator and have opposite effects on the output thereof. For example, the effect of an increase in the magnitude of the air current signal $I_A$ or of a decrease in the magnitude of the fuel current signal $I_F$ will be to draw current from and to unbalance the integrator which will increase its output to cause the fuel pump 26 to increase the fuel flow rate and, therefore, the amount of fuel supplied to the engine. The increased fuel supply is sensed by the fuel flowmeter 28 and will cause the fuel current signal $I_F$ to increase and inject more current into the integrator and rebalance it at a higher output voltage level sufficient to maintain the actual amount of fuel relative to the increased amount of air supplied to the engine in correspondence with the desired fuel-air ratio scheduled in the controller.

Figure 5A:
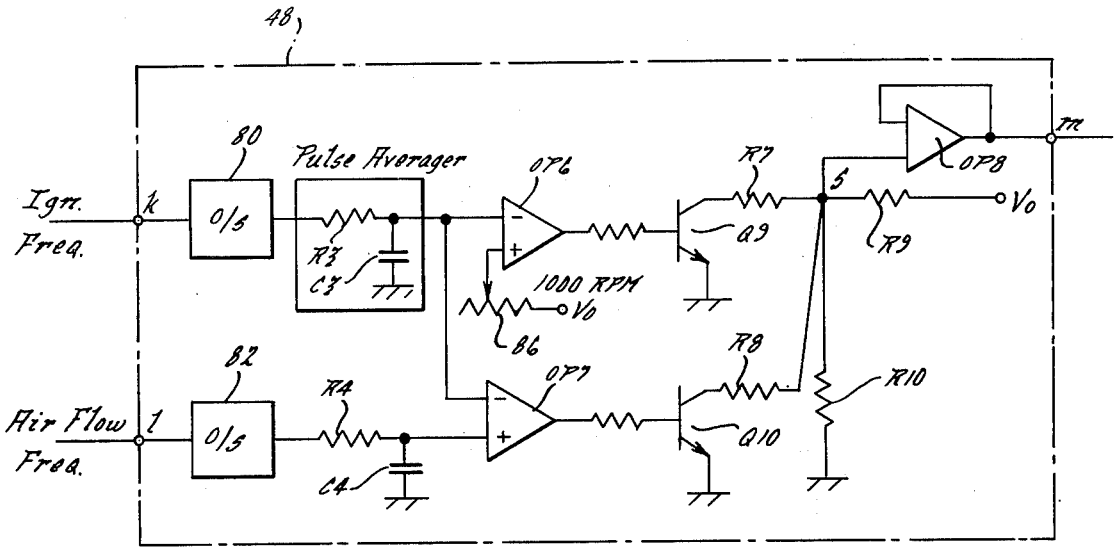
FIG. 5A is a diagrammatic and electrical circuit schematic of a form of fuel-air ratio scheduler suitable for use in the fuel metering systems described herein.

A simplified form of mass fuel-air ratio scheduler 48 suitable for use herein is shown functionally and schematically in FIG. 5A as having a pair of input terminals *k* and *l* and a signal output terminal *m.* The input terminals *l, k* are respectively connected to the air flowmeter 24 and to the ignition distributor 16 to receive a pulsatory signal whose frequency is related to the air flow rate $f_A$ in cubic feet/minute (*cfm*) and another pulsatory signal whose frequency is related to engine speed (*rpm*) and provide a signal at the output terminal *m* that is of a voltage level representative of the desired mass fuel-air ratios for the several different engine operating conditions shown in FIGS. 2A and 2B.

Input terminals *k* and *l* are connected internally of the scheduler 48 to a different one of a pair of signal processing channels, each of which includes a one-shot univibrator 80 (82), a pulse averager composed of a resistor $R_3(R_4)$ and capacitor $C_3$ $(C_4)$, an operational amplifier $OP_6$ $(OP_7)$ connected as a comparator, and a normally non-conducting switching amplifier $Q_9$ $(Q_{10})$. The switching amplifier $Q_9$ $(Q_{10})$ is connected through a resistor $R_7$ $(R_8)$ to change the voltage level at the junction point S of a pair of voltage divider resistors $R_9$ and $R_{10}$, which are connected to the fixed voltage reference source $V_o$. The voltage at the divider junctions is transferred through an operational amplifier $OP_8$ connected as a voltage follower to the output terminal *m* and has a predetermined initial voltage level which is representative of the fuel-air ratio selected for the cruise operating mode.

The ignition frequency or engine speed channel determines when the engine is operating below or has attained a predetermined engine speed of say, 1000 rpm for example, below which is defined the engine idle operating mode and for which an idle enrichment is required, as shown in FIG. 2A herein. The selected speed is factored into the system by potentiometer 86, which is connected to the non-inverting input terminal of the comparator OP6 and is adjusted to provide a voltage level representative of 1000 rpm. When the engine is in the idle mode, below 1000 rpm, the engine speed channel effectively switches resistor $R_7$ in parallel with $R_{10}$. Accordingly, the voltage at the divider junction will be reduced or lowered from that provided from the scheduler for operation of the engine in the cruise mode and will be representative of the desired fuel-air ratio for the idle enrichment mode as shown in FIG. 5C.

Both the air flow signal channel and the engine speed signal channel are used to determine when the engine is operating in the power mode, requiring a fuel enrichment from the mass fuel-air ratio provided for the cruise mode, and provide a signal having dimensions of air flow in cubic feet per minute and engine speed in revolutions per minute, or cubic feet or air per engine revolution. The latter quantity will be seen to be a measure of engine load or torque and can serve as an indication of an increased load operating condition, which will require an increased amount of fuel to power the engine, and is implemented or accomplished in the present invention with the comparator operational amplifier OP7 whose inverting input terminal is connected to the engine speed channel and whose non-inverting input terminal is connected to the air pulse frequency averager circuit as shown. Thus, when the pulse averaged air frequency signal becomes larger than the pulse averaged ignition frequency or engine speed signal, the resistor $R_8$ is effectively switched in parallel with resistor $R_{10}$ to further change the voltage at the divider junction point S to a still lower level corresponding to the higher fuel-air ratio scheduled for the power enrichment mode, as indicated in FIG. 5C.

Figure 5B:
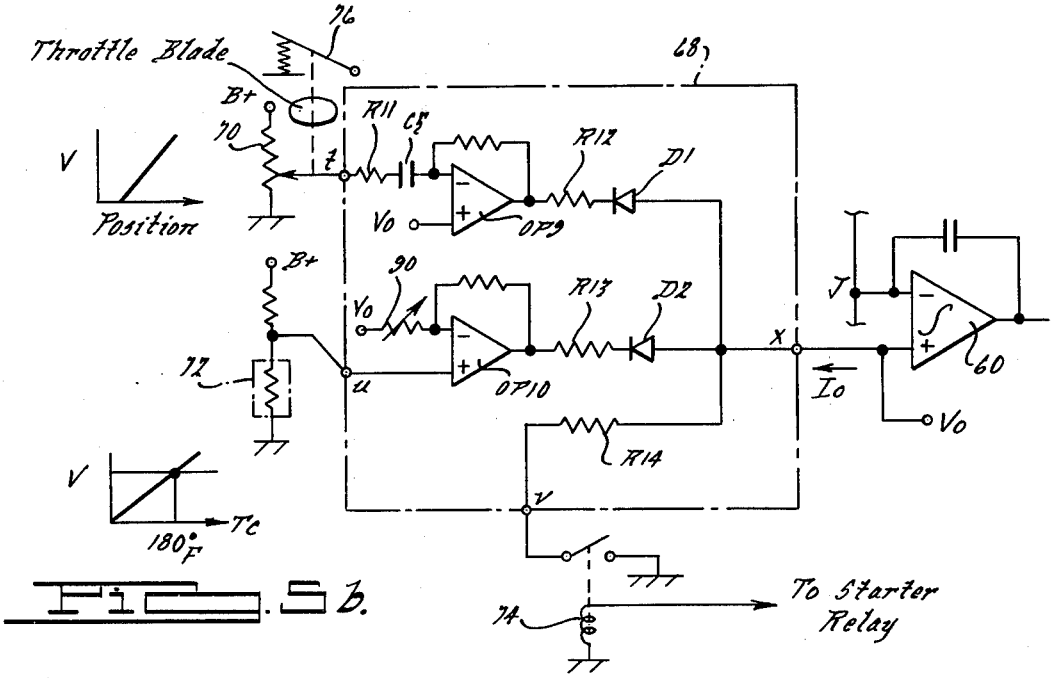
FIG. 5B is a schematic electrical circuit of a form of off-set scheduler suitable for use in the fuel metering systems described herein including transfer characteristics of the transducers employed therein.
Figure 5C:
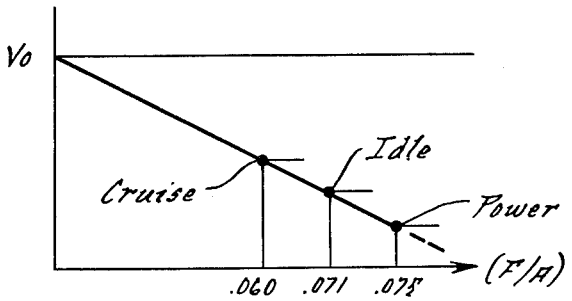
FIG. 5C illustrates the output voltage to desired fuel-air radio transfer characteristic of the fuel-air ratio scheduler employed in the fuel metering systems described herein.

FIG. 5B is a form of offset scheduler 68 suitable for use in the present invention for drawing offset current $I_o$ from the integrator 60 to modify the amount of fuel supplied to the engine during engine starting, cold engine operation and vehicle acceleration conditions. These conditions are sensed respectively by the throttle position transducer 70, engine coolant or temperature transducer 72 and a relay operated switch 74 or equivalent device responsive to the starting operation of the engine.

The throttle position transducer is shown as a variable linear resistance device, which is connected to the electronic system supply voltage B+ and has its slider movably positioned by the throttle blade in the throttle body 14 in response to movement of the vehicle accelerator pedal 76 by the operator of the vehicle. The slider of the potentiometer 70 is connected to the input terminal *t* of the acceleration enrichment channel of the offset scheduler that includes the serially connected resistor $R_{11}$ and capacitor $C_5$, a differential operational amplifier OP9, a resistor $R_{12}$ and diode $D_1$ whose anode is connected to the output terminal *x* of the offset scheduler 68.

When the accelerator pedal 76 of the vehicle is depressed to initiate an acceleration condition, the change in voltage level is applied through capacitor $C_5$ to the inverting input terminal of the differential operational amplifier OP9 whose other terminal is shown connected to the reference voltage source $V_o$. The acceleration sensing signal applied to the operational amplifier reduces the voltage level at the output of the amplifier to forward bias diode $D_1$ and draw current from the integrator. The current drawn from the integrator will cause the voltage output of the integrator to rise and increase the drive to the fuel pump, thereby enabling enrichment of the fuel-air ratio to provide for the increased amount of fuel necessary to power the engine and accelerate the vehicle.

The necessary fuel enrichment for cold engine operation is provided by the cold enrichment circuit channel which receives an input signal at its input terminal *u* from the junction of a fixed voltage divider formed with a PTC linear resistance thermistor element 72 responsive to engine coolant temperature $T_c$ in the case of a water cooled engine. The input terminal *u* of the offset scheduler 68 is shown connected to the non-inverting input terminal of a comparator operational amplifier $OP_{10}$ whose inverting input terminal is connected to the slider arm of an adjustable potentiometer 90 connected to the voltage source $V_o$. The slider arm of the potentiometer is set to provide a voltage corresponding to a coolant temperature of, say, 180° F, below which it is desired to provide the necessary fuel enrichment for cold engine operation. Thus, so long as the engine coolant temperature as sensed by the thermistor 72 is below the selected critical temperature, the voltage level at the output of the operational amplifier $OP_{10}$ will be less than the voltage level $V_o$ at the anode of the diode $D_2$ to forward bias and permit conduction of a programmable amount of offset current through the latter from the integrator.

The remaining channel of the offset controller is connected through resistor $R_{14}$ to terminal *v* which is adapted to be connected to ground through a normally open set of switch contacts 74' of a relay whose actuating coil is shown at 74. Coil 74 is connected to a point in the vehicle wiring system that is responsive to or reflects the starting condition of the vehicle, as the starter motor relay or contacts, and when energized completes the starting channel to draw the amount of offset current through $R_{14}$ from the integrator that is required to provide the desired amount of starting fuel enrichment.

A form of fuel controller suitable for use herein is shown in schematic form in FIG. 4 herein and connected to the output of the integrator 60 through a Zener low voltage diode Z. The circuit includes the transistors $Q_{11}$, $Q_{12}$ and $Q_{13}$, resistor $R_{16}$, capacitor $C_6$ and the feedback stabilizing network 66, which is composed of the resistor $R_{17}$ and capacitor $C_7$. Transistor $Q_{11}$ provides the base current path for $Q_{12}$, which supplies drive current for the output switching transistor $Q_{13}$ to complete the ground return circuit for the pump motor 26 whose high potential side is connected to the vehicle battery source $V_{BATT}$. Thus, when input $Q_{11}$ is off, $Q_{12}$ and $Q_{13}$ are also off, whereby the voltage at the collector of $Q_{13}$ is high or $V_{BATT}$ and the motor 26 is deenergized.

When the output voltage level of the integrator rises 60, $Q_{11}$ turns on, turning on $Q_{12}$ and $Q_{13}$ whose collector voltage drops to nearly ground. The sudden voltage drop is transferred through $C_6$ and causes the potential at the emitter of $Q_{11}$ to drop accordingly to a level of approximately $V_{BATT}$ below ground, thus driving $Q_{11}$ into saturation and produces a rapid switching form of regenerative feedback action maintaining $Q_{11}$ conducting. $Q_{11}$ remains conducting for a time period determined by the RC time constant of $R_{16}$, $C_6$, which may be in the order of, say, 0.1 milliseconds, for example.

When $Q_{12}$ turned on, the voltage at its collector rises and causes current to flow through the feedback stabilizer network $R_{17}$, $C_7$ and into the integrator, injecting more current into the integrator to cause its output to start to decrease until the corresponding voltage (less the Zener drop) at the base of input transistor $Q_{11}$ falls to a level one base-emitter drop above the voltage at the emitter of $Q_{11}$, which is following the charging curve of $R_{16}$, $C_6$ towards a positive voltage above ground, at which time $Q_{11}$ turns off. $Q_{11}$ turns off $Q_{12}$ and $Q_{13}$ to deenergize the pump motor 26, whereupon the voltage at the collector of $Q_{13}$ jumps to $V_{BATT}$, which change is transferred through $C_6$ to hold $Q_{11}$ shut off. $C_6$ then commences to charge in the opposite direction from $V_{BATT}$ towards ground, and current is then extracted from the integrator through the stabilizing network $R_{17}$, $C_7$, which has a time constant in the order of one millisecond. The extraction of current from the integrator causes its output to increase until the voltage at the emitter of $Q_1$, which is following the decay of $R_{16}$, $C_6$, falls one base-emitter voltage drop ($V_{be}$) below the output of the integrator less the drop across the Zener diode, at which time $Q_{11}$ is caused to turn on again.

The current supplied through the stabilizer network corresponds to the rate of change of the duty-cycle drive of the fuel controller and results in desirable damping and stabilization of the system. It will be noted that, because the feedback is capacitor coupled, the time average of the feedback current is zero and does not affect the metering accuracy under steady state conditions.

Turning now to the fuel metering equations defining the operation of the invention, the system is designed so that the output of the integrator will be stable or balanced when the average value of the fuel signal current $I_F$ is equal and opposite to the average value of air signal current $I_A$. As previously indicated, the current signal $I_F$ is developed by the train of output pulses from the fuel channel applied through the integrator resistor $R_F$ and will have an average value represented by the following equation:

$$I_F = \frac{f_F \cdot t_F(P_A)\,[V_F(T_A) - V_o]}{R_F} \quad (1),$$

where $f_F$ is the fuel pulse repetition rate which varies with the volumetric rate of fuel flow;

$t_F(P_A)$ is the fuel pulse width, which is a function of and varies inversely with barometric pressure $P_A$ in a manner expressed by the equation $$t_F(P_A) = \frac{1}{K_2 P_A} \quad (2)$$

representing the $t_F$ - $P_A$ transfer characteristic shown in FIG. 3 of the pulse width controller; and where $[V_F(T_A) - V_o]$ is the fuel pulse amplitude $V_F$, which may be further represented by the equation:

$$V_F = V_F(T_A) - V_o = T_A/K_3. \quad (3).$$

The air signal current $I_A$ is developed by the train of output pulses from the air signal channel applied to the integrator resistor $R_A$ and will have an average value represented by the following equation:

$$I_A = \frac{f_A \cdot t_A(T_F)\,[V_o - V_A(F/A)]}{R_A} \quad (4),$$

where $f_A$ is the air pulse repetition rate, which varies with the volumetric air flow rate;

$t_A(T_F)$ is the air pulse width, which is a function of fuel temperature varying inversely with fuel density $\rho_F$ as represented by the following equation:

$$t_A(T_F) = \frac{1}{K_1 \rho_F} \quad (5);$$

and where $[V_o - V_A(F/A)]$ is the air pulse amplitude characteristic $V_A$ represented in FIG. 3 and the equation $$V_A = [V_o - V_A(F/A)] = K_4 \cdot (F/A) \quad (6)$$

The integrator thus integrates the air current signal pulses and the opposite polarity fuel current signal pulses, and provides a voltage output therefrom, which, in accordance with the present invention, is stable when the average current $I_F$ of the fuel pulses is equal and opposite to the average current $I_A$ of the air pulses as represented by the following equation:

$$\frac{f_F \cdot t_F(P_A)\,[V_F(T_A) - V_o]}{R_F} = \frac{f_A \cdot t_A(t_F)\,[V_o - V_A(F/A)]}{R_A} \quad (7).$$

Since fuel mass flow and air mass flow are related to their respective volumetric fuel and air flow rates $f_F$ and $f_A$ and their fuel and air density parameters as expressed by the following equations:

$$\text{Fuel mass flow} = K_5 f_F \rho_F \quad (8) \text{ and}$$

$$\text{Air Mass flow} = K_6 f_A \rho_A \quad (9),$$

the volumetric fuel and air flow terms $f_F$ and $f_A$ may be expressed in terms of their mass flow and density relationships and substituted in equation (7) above in which the terms $t_F(P_A)$; $t_A(t_F)$; $[V_F(T_A) - V_o]$ and $[V_o - V_A(F/A)]$ may also be expressed by their relationships represented in equations (2), (5), (3) and (6) respectively.

The above substitutions will then transform the fuel metering equation (7) to:

$$\frac{\text{Fuel Mass Flow}}{\text{Air Mass Flow}} = \frac{K_2 K_3 K_4 K_5}{K_1 K_6} \cdot \frac{R_F}{R_A} (F/A) \quad (10).$$

By designing the circuitry so that $$\frac{K_2 K_3 K_4 K_5}{K_1 K_6} \cdot \frac{R_F}{R_A} = 1 \quad (11),$$

then the stable or balanced condition of the integrator 60 will occur when the actual mass fuel to air ratio is equal to the desired ratio (F/A) scheduled for the engine.

If means are provided to draw offset current from the input of the integrator, this current will cause additional fuel to flow above that corresponding to the measured air flow. The balance equation for the integrator is then:

$$\frac{f_F \cdot t_F(P_A)\,[V_F(T_A) - V_o]}{R_F} = \frac{f_A \cdot t_A(T_F)\,[V_o - V_A(F/A)]}{R_A} + I_{offset} \quad (12).$$

By making the previously described substitutions, the fuel metering equation becomes:

$$\frac{\text{Fuel Mass Flow}}{\text{Air Mass Flow}} = \frac{K_2 K_3 K_4 K_5}{K_1 K_6} \cdot \frac{R_F}{R_A} (F/A) + \frac{K_2 K_3 K_5 \rho_F}{K_6 f_A} \cdot I_{offset} \quad (13).$$

The amount of additional fuel required to balance the offset current will then be found to be:

$$\text{Additional Mass Fuel Flow} = \frac{K_2 K_3 K_5 P_A R_F}{T_A} \cdot I_{offset} \quad (14).$$

FIGS. 6A–F illustrate the effect of drawing offset current $I_o$ from the integrator for an acceleration from idle to a given cruising speed and the waveforms which might be observed in the system during operation of the engine in these various modes.

Figure 6:
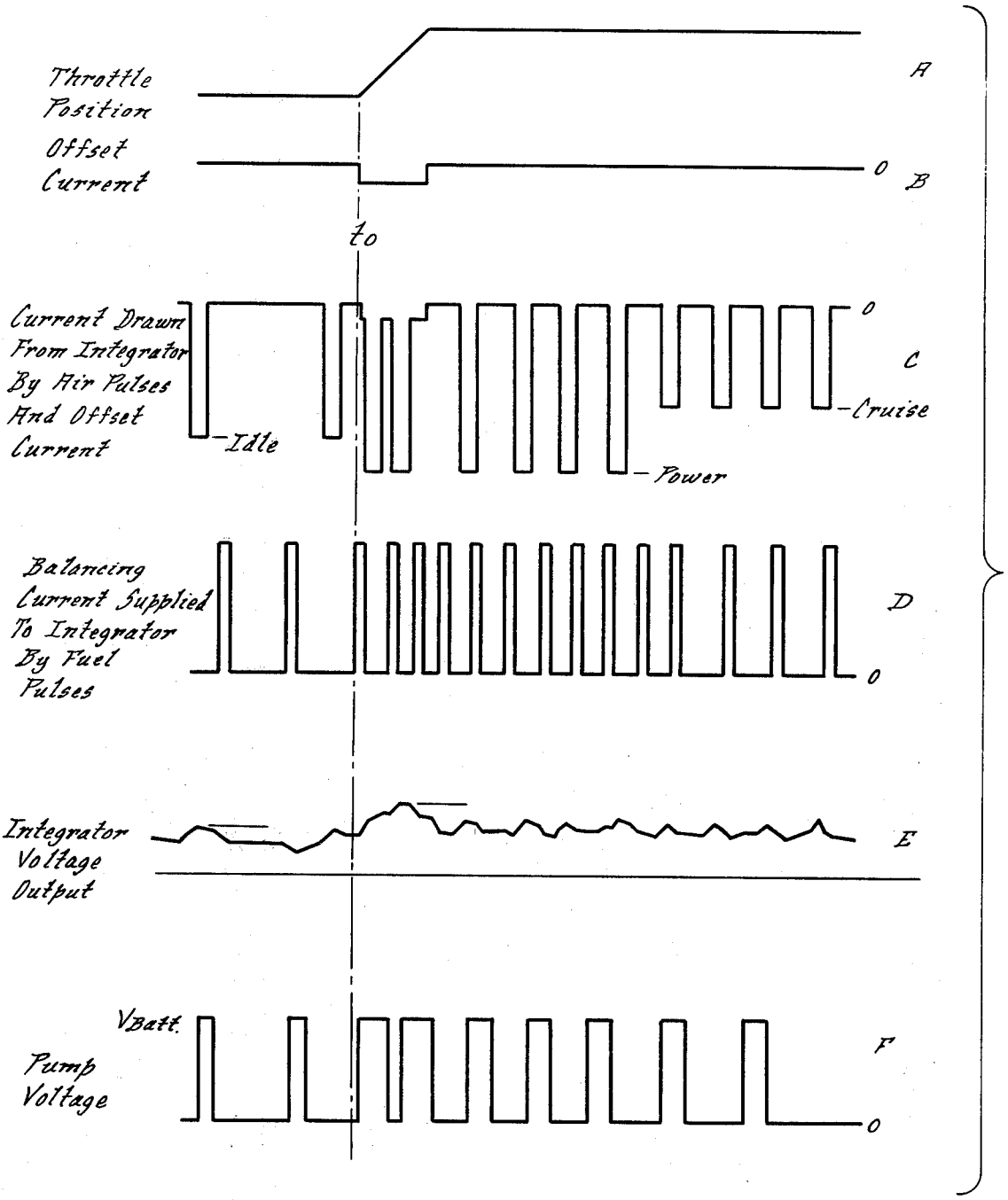
FIGS. 6A–F illustrate waveforms which might be observed in the system and, specifically, the effect of offset current on the fuel and air current pulses and the character of the output of the integrator and of the variable duty cycle drive to the pump motor during an acceleration from idle to a given cruising speed mode of operation of the engine.

At engine idle, the current drawn from the integrator by the air pulses will be of a pulse amplitude shown in FIG. 6C determine by the output of the fuel air scheduler 48, the amplitude of the air pulses being of a higher level at idle than that for cruising speed operation as further illustrated in FIG. 6C.

FIG. 6D illustrates the current supplied by the fuel pulses to balance the integrator 60 whose output, shown as being a slewing character in FIG. 6E, is applied to the fuel controller circuitry to produce the variable duty-cycle drive for the pump motor 26 as shown in FIG. 6F.

FIG. 6A illustrates the change in the engine throttle position at a time $t_o$ to accelerate the vehicle from engine idle to a given cruising speed and the corresponding offset current $I_o$ caused to be drawn from the integrator by the offset scheduler 68 responsive to the acceleration operation of the vehicle. The effect of the increased current drawn from the integrator by the air pulses and the offset current during the acceleration mode will be to increase fuel flow and the number of fuel pulses, which will increase the fuel current signal and thereby balance the integrator at a higher output voltage level than the output level obtaining at the idle mode.

It will be noted that the described embodiment of the invention is based on the use of linear transducers, which reduce the cost, facilitate the implementation of the apparatus and improve the accuracy thereof. The desired fuel-air (F/A) ratio parameter from the scheduler is injected as a control function in the air or fuel signal channel to modify a pulse characteristic of one or the other of fuel or air current signals and is not injected into the integrator or summer nor with the correction and other signals into the fuel metering channel or portion of the system, whereby the programming and the fuel metering functions of the present invention are separate and distinct and are not combined as in the prior systems mentioned earlier herein. In consequence, the implementation of the scheduler and the system are greatly simplified and, more importantly, the accuracy and precision of the system is greatly enhanced and extended to cause the acutal mass fuel-air ratio to correspond to the desired mass fuel-air ratio over an extended range of engine operation and engine operating and ambient fluid variation conditions.

It will also be noted that in the decribed embodiment of the invention, the air flowmeter and the fuel flowmeter were both assumed to be of the volumetric flow variety and provide output signals therefrom whose pulse width and pulse amplitude characteristics are modulated or otherwise modified to provide a form of volumetric to mass flow correction in either one or both of the signal channels by the barometric pressure $P_A$ transducer 36, air temperature $T_A$ transducer 38, fuel temperature $T_F$ transducer 42 and the desired mass fuel-air ratio program or scheduler 48.

The aforesaid transducers and scheduler device exert their control functions at the points shown in FIGS. 3 and 4, which are illustrative of a preferred form of one embodiment of the invention but are not to be taken in a limiting sense. Other positions or points at which these transducers and the scheduler may exert their control functions are also possible; for example, the channel or circuit location or position of the air temperature transducer 38 and the fuel temperature transducer 42 can be interchanged, and the respective transducers placed in the opposite signal channel from which they are shown, whereby the air temperature transducer will control the width of the air signal pulses and the fuel temperature transducer will control the amplitude of the fuel pulses.

It is further possible to interchange the location of the barometric pressure transducer 36 and its energizing source with the mass F/A scheduler 48 and to have the barometric pressure $P_A$ transducer exert its control function or influence on the amplitude of the air pulses and to place the mass fuel-air scheduler 48 in the fuel pulse channel to perform the pulse width control of the fuel pulses, although in this modification, the scheduler would exert a control influence on the pulse width of the fuel pulses based on an air to fuel rather than on a fuel to air ratio schedule.

The resistors $R_F$ and/or $R_A$, further, could be PTC coefficient thermistors responsive to the fuel temperature and/or the air temperature, respectively, as indicated by the resistor $R_A$ in FIG. 4A for example, and thus can provide an additional or alternate point of control in either of the signal channels for performing an amplitude control function on the fuel or air pulses.

It is also possible to inject all of the control parameters in one or the other of the signal channels as the air flow channel for example in which the capacitor $C_1$ in the pulse width controller 44 could be a capacitive type pressure transducer responsive to barometric pressure $P_A$ so that the pulse width of the air pulses can thus be modulated by both the fuel temperature pulse width control voltage and the barometric pressure transducer. The fuel air ratio scheduler could then be used to vary the amplitude of the air pulses in accordance with the mass fuel-air scheduler, while a further amplitude control on the air pulses can be exercised by the resistor $R_A$ which can be a thermistor responsive to the air temperature.

The foregoing embodiments of the invention were based upon the assumption that both the air flowmeter and the fuel flowmeter were of the volumetric flow variety, which would require a determination of the fuel temperature as well as the barometric pressure and air temperature to inject the density correction factors for conversion of the volumetric to mass flow information.

In practice, the fuel flowmeter may be of the mass flow variety, as, for example, closely approximated by the use of a paddle wheel type of flowmeter, the flow from which is substantially mass flow information, so that it is not necessary to make density corrections to the volumetric information based on the fuel temperature. Accordingly, FIGS. 7 and 8 illustrate further embodiments of the invention for two additional forms of fuel metering systems, which are based on the use of a linear volumetric air flowmeter and a mass fuel flowmeter and which do not employ the fuel temperature as a mass flow correction or compensation factor therein.

Figure 7:
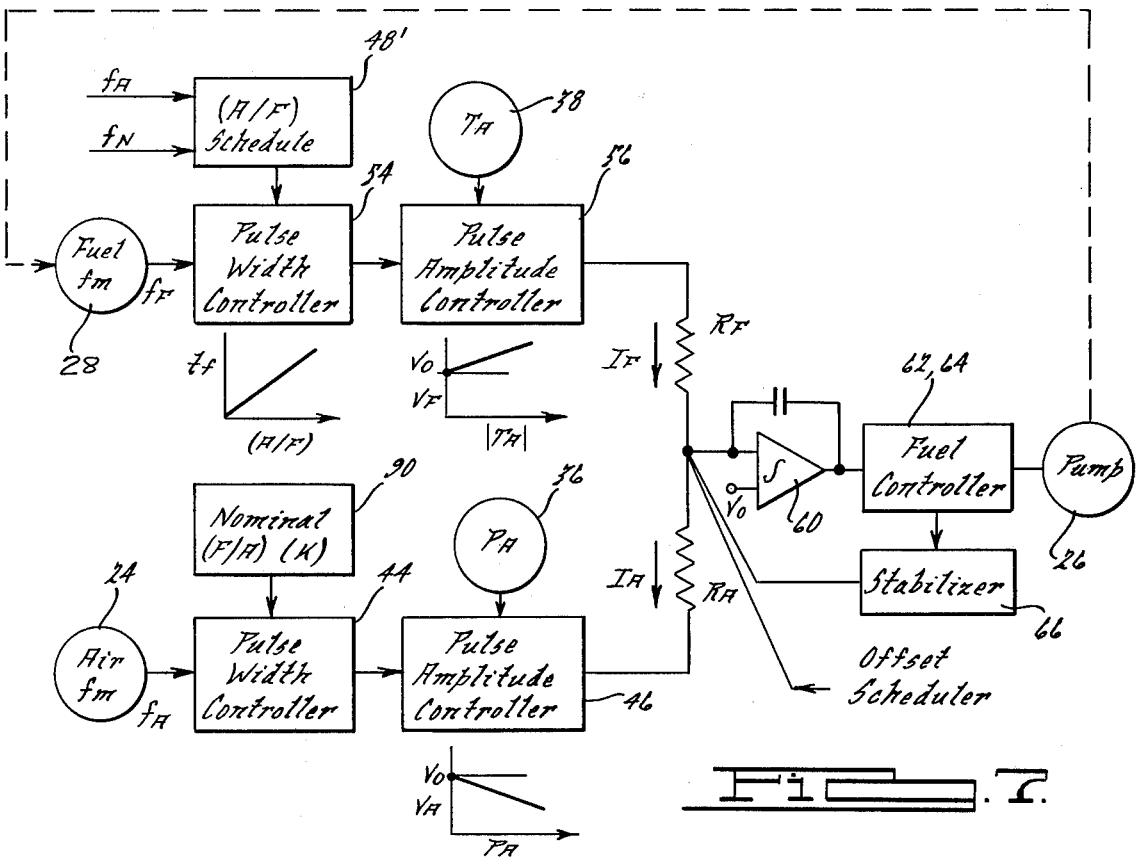
FIG. 7 is a block diagram of another modification of the system of FIG. 3 including the transfer characteristics of several of the components therein.

In FIG. 7, the fuel-air, or more properly, air fuel scheduler 48' controls the width of the fuel pulses as a function of the air-fuel ratio and varies as the depicted transfer characteristic, while the amplitude of the fuel pulses is under the control of the absolute air temperature transducer $T_A$ and associated source and varies in direct linear proportion thereto as depicted. The air flow channel has the amplitude of the air flow signals controlled by the barometric pressure transducer $P_A$ and varies in direct linear proportion thereto as depicted, while the width of the air pulses is set by a nominal fuel-air scheduler 88 which provides a fixed and constant output therefrom set as a factory adjustment for each individual engine.

Figure 8:
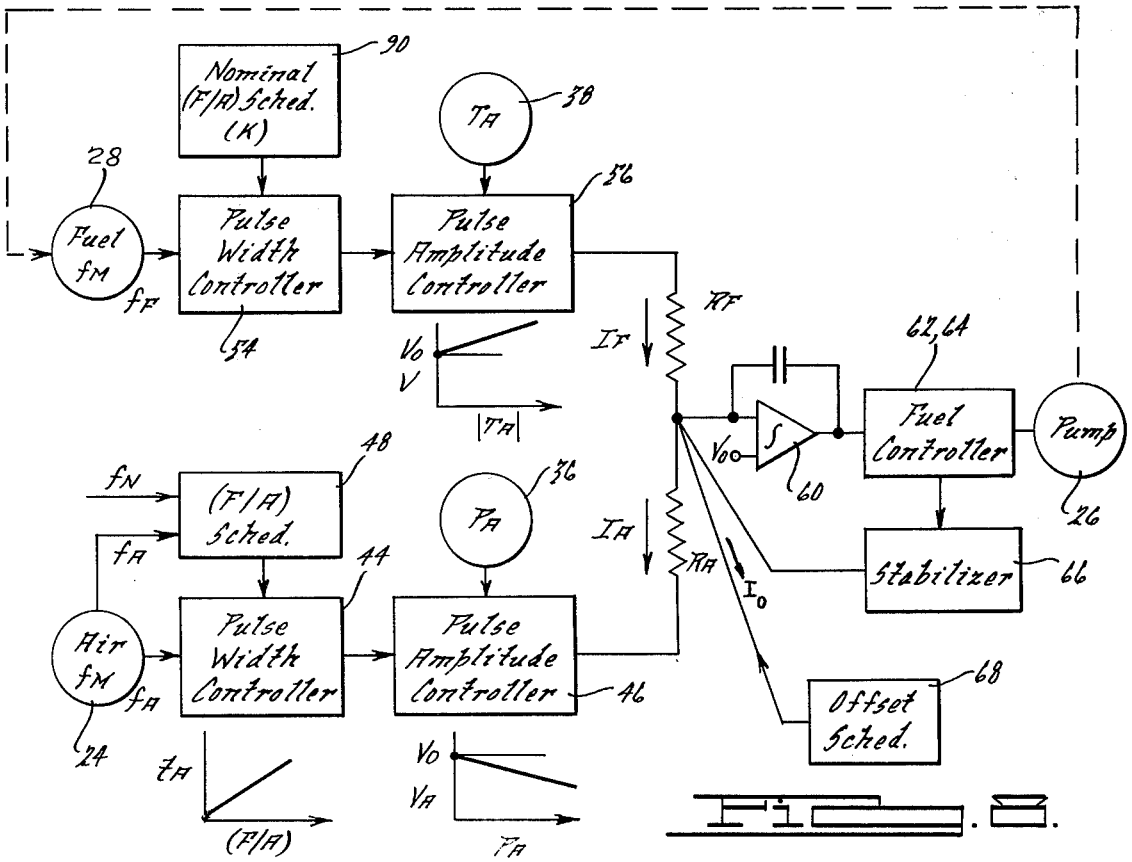
FIG. 8 is a block diagram of still another and preferred modification of a fuel metering system including the transfer characteristics of the components for implementation thereof.

In FIG. 8, which is the preferred embodiment of the invention illustrated herein, the nominal fuel-air or factory set adjustment is made in the fuel flow channel to the pulse width of the fuel pulses, and the fuel-air scheduler 48 is then used to control the pulse width of the air flow pulses in the air flow channel as a fuel-air ratio function as depicted. The amplitude of the fuel pulses is controlled by the absolute air temperature responsive transducer and the amplitude of the air pulse signals is controlled by the barometric pressure transducer $P_A$ in accordance with the depicted transfer characteristics. The output pulses from the fuel pulse amplitude controller and the air pulse amplitude controller are applied through the respective integrating resistors $R_F$ and $R_A$ to the integrator 60, the remainder of the systems of FIGS. 7 and 8 being the same as that previously described herein. An additional or alternative point of control for controlling the amplitude of the air current signal pulses would be by the use of a PTC thermistor element responsive to absolute air temperature for the resistor $R_A$ as indicated in FIG. 4A.

It will be appreciated that the equations representing the waveform parameters of the fuel and air current signals will be somewhat different from the equations set out earlier herein for the FIGS. 3 and 4 embodiment of the invention. However, the equations and substitutions can be readily derived in accordance with the foregoing teachings and balance condition relationship and will reduce to the desired fuel metering equations (10) and (11) with a substitution of different constants.

What is claimed is:

1. In a closed loop regulated fuel metering system for supplying a quantity of fuel for combustion with the air ingested by an internal combustion engine and maintaining a scheduled mass ratio between the fuel and air both supplied in fluid form to the engine, said system comprising in combination, means for sensing a selected set of ambient parameters which affect the mass flow of at least one of said fluids, mass fuel-air ratio scheduling means responsive to at least one mode of engine operation and providing an output signal representative of a desired mass fuel-air ratio for that mode of operation of the engine, means for sensing the air supplied to the engine and generating a pulsatory electrical signal whose pulse repetition rate characteristic varies with the volumetric flow rate thereof, means for sensing the fuel supplied to the engine and generating a pulsatory electrical signal having a pulse repetition rate characteristic which varies with the volumetric flow rate thereof, means for modifying a pulse characteristic of one of said pulsatory fluid flow signals in accordance with a function of said desired mass fuel-air ratio representative signal from said mass fuel-air ratio scheduling means, correction means for additionally modifying a pulse characteristic of one of said pulsatory fluid flow signals in accordance with at least one ambient parameter of said set of ambient parameters, and control means responsive to and electrically combining said fluid flow signals as modified by said scheduled mass fuel-air ratio signal and by said correction means for controlling the mass flow of fuel ralative to the air into the engine in accordance with a predetermined relationship between said fluid flow signals that will maintain the actual mass flow of fuel supplied to the engine relative to the air ingested thereby in correspondence with the desired mass fuel-air ratio scheduled by said mass fuel-air ratio scheduling means.

2. A fuel metering system in accordance with claim 1 wherein said predetermined relationship is one of equality between the average value of said fuel signal and the average value of said air signal.

3. A fuel metering system in accordance with claim 1 wherein both said mass fuel-air ratio scheduling means and said correction means, modify the air flow signal.

4. A fuel metering system in accordance with claim 1 wherein said mass fuel-air ratio scheduling means modifies one of said pulsatory fluid flow signals as a function of said scheduled fuel-air ratio and said correction means modifies the other one of said pulsatory fluid flow signals.

5. A fuel metering system in accordance with claim 4 wherein said mass fuel-air ratio scheduling means modifies the air flow signal and said correction means modifies said fuel flow signal.

6. A fuel metering system in accordance with claim 4 wherein said mass fuel-air ratio scheduling means modifies the fuel flow signal as a function of said scheduled fuel-air ratio and said correction means modifies said air flow signal.

7. A fuel metering system in accordance with claim 4 further wherein said correction means modifies the other of said fluid flow signals directly in accordance with the temperature of one of said fluid flow signals.

8. A fuel metering system in accordance with claim 4 wherein said correction means modifies both said fuel flow signal and said air flow signal, each in accordance with a different ambient parameter of said selected set of sensed ambient parameters of said fluids.

9. A fuel metering system in accordance with claim 8 further wherein said selected set of ambient fluid parameters includes the absolute temperature of one of said fluids and barometric pressure.

10. A fuel metering system in accordance with claim 9 further wherein the correction means modifies the air flow signal in accordance with barometric pressure and also modifies the fuel flow signal in accordance with the absolute temperature of one of said fluids.

11. A fuel metering system in accordance with claim 9 further wherein the fuel flow signal is modified in accordance with the absolute temperature of the air surrounding the engine.

12. A fuel metering system in accordance with claim 10 further wherein the mass fuel air ratio scheduling means modifies the air flow signal and wherein the correction means additionally modifies the air flow signal in accordance with barometric pressure and also modifies the fuel flow signal in accordance with the absolute temperature of the air surrounding the engine.

13. A fuel metering system in accordance with claim 12 further wherein the mass fuel air ratio scheduling means modifies the pulse width characteristic of the pulsatory air flow signal and wherein said correction means modifies the pulse amplitude characteristic of the pulsatory air flow signal in accordance with barometric pressure and the pulse amplitude characteristic of the pulsatory fuel flow signal in accordance with absolute air temperature.

14. A fuel metering system in accordance with claim 13 further wherein the pulse width characteristic of said air flow signal is modified by a signal from a current source which produces a current that varies linearly with the desired mass fuel-air ratio.

15. A fuel metering system in accordance with claim 14 further wherein the means for modifying the pulse width characteristic of said air flow signal is a one-shot univibrator which receives said signal from said current source proportional to the mass fuel-air ratio.

16. A fuel metering system in accordance with claim 4 wherein said mass fuel-air ratio scheduling means modifies the fuel flow signal in accordance ith a function of the desired mass air-fuel ratio and wherein said correction means modifies the fuel flow signal in accordance with absolute air temperature and also modifies the air flow signal in accordance with atmospheric pressure.

17. A fuel metering system in accordance with claim 16 wherein said mass fuel-air ratio scheduling means modifies the pulse width characteristic of said pulsatory fuel flow signal and said correction means modifies the pulse amplitude characteristic of said pulsatory fuel flow signal and of said pulsatory air flow signal.

18. A fuel metering system in accordance with claim 17 wherein the pulse width characteristic of said pulsatory fuel flow signal increases with an increase in the air-fuel ratio representative signal from said scheduling means, the pulse amplitude characteristic of said fuel flow signal increases with an increase in absolute air temperature and the pulse amplitude characteristic of said pulsatory air flow signal increases with barometric pressure.

19. A fuel metering system in accordance with claim 4 further wherein said selected set of ambient fluid parameters include the absolute temperture of the air surrounding the engine, barometric pressure and the absolute temperature of the fuel supplied to the engine.

20. A fuel metering system in accordance with claim 19 further wherein the said mass fuel air ratio scheduling means modifies the air flow signal and wherein the correction means additionally modifies the air flow signal in accordance with the absolute temperature of the fuel and further modifies the fuel flow signal in accordance with the barometric pressure and the absolute temperature of the air surrounding the engine.

21. A fuel metering system in accordance with claim 20 further wherein the mass fuel air ratio scheduling means modifies the pulse amplitude characteristic of the pulsatory air flow signal in accordance with the scheduled mass fuel-air ratio and wherein the correction means modifies the pulse width characteristic of the pulsatory air flow signal in accordance with the absolute temperature of the fuel, the pulse width characteristic of the pulstory fuel flow signal in accordance with barometric pressure and the pulse amplitude characteristic of the pulsatory fuel flow signal in accordance with absolute temperature of the air surrounding the engine.

22. A fuel metering system in accordance with claim 21 wherein the pulse width characteristic of said pulsatory fuel flow signal decreases with an increase in barometric pressure and its pulse amplitude characteristic increases with an increase in absolute air temperature and wherein the pulse width characteristic of said pulsatory air flow signal increases with the absolute temperature of the fuel and its pulse amplitude characteristic increases with an increase in the scheduled fuel-air ratio.

23. A fuel metering system in accordance with claim 1 wherein said control means includes a integrator means connected to receive fuel flow and air flow signals at one node thereof as modified by said mass fuel air scheduling means and said correction means and providing a stable output therefrom when said fluid flow signals bear a predetermined relationship to one another.

24. A fuel metering system in accordance with claim 23 wherein said predetermined relationship is one of equality between the average value of said fuel flow and air flow signals.

25. A fuel metering system in accordance with claim 23 wherein said control means further includes fuel controller means for supplying fuel to the engine in accordance with the signal supplied thereto from said integrator means and means for driving said fuel controller means with variable duty cycle aperiodic energization from a fixed voltage supply source.

26. A fuel metering system in accordance with claim 25 wherein said fuel controller means is a pump having a variable speed electrical drive motor.

27. A fuel metering system in accordance with claim 25 wherein said fuel controller drive means comprises a voltage to variable duty cycle converter means connected to the output of said integrator means and a solid state switching amplifier connected to said fuel controller means.

28. A fuel metering system in accordance with claim 27 wherein said fuel controller drive means includes regenerative feedback circuit means to promote positive and rapid on-off switching action therein.

29. A fuel metering system in accordance with claim 27 including feedback stabilizing means connected between the output of the voltage to variable duty cycle converter means and an input of the integrator means.

30. A fuel metering system in accordance with claim 29 wherein said feedback stabilizer means is of a degenerative character providing a derivative feedback control proportional to the rate of change in the duty cycle energization of the fuel controller means.

31. A fuel metering system in accordance with claim 23 including offset scheduler means connected to draw offset current from the integrator means in response to engine operating conditions requiring an enrichment of the mass fuel-air ratio for operation of the engine.

32. A fuel metering system in accordance with claim 31 for a motor vehicle internal combustion engine wherein said offset scheduler means includes means responsive to a vehicle acceleration condition, means responsive to engine temperature and means responsive to an engine starting condition for operating said offset scheduler means to draw offset current from said integrator means during vehicle acceleration, engine starting and cold engine operating conditions.

33. A fuel metering system in accordance with claim 1 wherein said mass fuel air ratio scheduling means is responsive to a signal having a frequency proportional to the frequency of said air flow signal and to another signal having a frequency proportional to the speed of the engine and provides an output signal therefrom, which is representative of the desired mass fuel-air ratio and is of a different level for the cruising, idle and power operating modes of the vehicle.

34. A fuel metering system in accordance with claim 1 wherein said air flow sensing means includes a vortex type flowmeter providing volumetric air flow information.

35. A fuel metering system in accordance with claim 1 wherein said fuel flow sensing means includes a paddle wheel fuel flow meter.

36. A fuel metering system in accordance with claim 1 wherein said ambient parameters are sensed by linear transducers.

37. A fuel metering system in accordance with claim 13 further including means for establishing the pulse width characteristic of said pulsatory fuel flow signal in accordance with a nominal fuel-air ratio schedule signal of a fixed level as a preset adjustment for each individual engine.

38. A method of supplying a quantity of fuel for combustion with the air ingested by an internal combustion engine of a vehicle and maintaining a scheduled mass ratio between the fuel and air both supplied in fluid form to the engine comprising the steps of:

sensing a selected set of ambient parameters which affect the mass flow of at least one of said fluids and generating electrical signals each related to a different one of said sensed ambient fluid parameters, generating an electrical signal in response to at least one mode of engine operation and representative of a desired mass fuel-air ratio for that mode of operation of the engine, sensing the air supplied to the engine and generating a pulsatory electrical signal whose pulse repetition rate characteristic varies with the volumetric flow rate thereof, sensing the fuel supplied to the engine and generating a pulsatory electrical current signal having a pulse repetition rate characteristic which varies with the volumetric flow rate thereof, modifying a pulse characteristic of one of said pulsatory fluid flow signals in accordance with a function of said desired mass fuel-air ratio representative signal, additionally modifying a pulse characteristic of one of said pulsatory fluid flow signals in accordance with at least one ambient parameter related signal of said set of sensed ambient fluid parameters, and thereafter electrically combining said modified fluid flow signals for controlling the mass flow of fuel relative to the air into the engine in accordance with a predetermined relationship between said fluid flow signals that will maintain the actual mass flow of fuel supplied to the engine relative to the air ingested thereby in accordance with the desired mass fuel-air ratio signal.

39. A method in accordance with claim 38 above wherein said fluid flow signals are electrically differentially combined.

40. A method in accordance with claim 38 above wherein said fluid flow signals are of opposite polarity and are electrically algebraically combined.

41. A fuel metering system in accordance with claim 1 above wherein said fluid flow signals are electrically differentially combined.

42. A fuel metering system in accordance with claim 1 above wherein said fluid flow signals are of opposite polarity and are electrically algebraically combined.

43. A fuel metering system in accordance with claim 23 wherein said fluid flow signals are electrical current signals and said integrator is a current integrator.

44. A fuel metering system in accordance with claim 1 wherein said mass fuel-air ratio scheduling means provides a different output signal in response to and representative of each different operating mode of the engine requiring a different desired mass fuel-air ratio.

45. A fuel metering system in accordance with claim 44 above wherein both said mass fuel-air ratio scheduling means and said correction means modify a pulse characteristic of the same one of said pulsatory fluid flow signals.

46. A fuel metering system in accordance with claim 44 above wherein said mass fuel-air ratio scheduling means and said correction means modify a different one of said pulsatory fluid flow signals and wherein the pulse characteristic of the pulsatory fluid flow signal modified by said fuel-air ratio scheduling means is a different pulse characteristic than that modified by said correction means applied to the other pulsatory fluid flow signal.

47. In a closed loop regulated fluid metering system for supplying a quantity of a first fluid for combustion with a quantity of a second fluid ingested by an internal combustion engine and maintaining a scheduled mass ratio between the two fluids, said system comprising in combination, means for sensing a selected set of ambient parameters which affect the mass flow rate of at least one of said fluids, mass fluid ratio scheduling means responsive to several different modes of engine operation and providing a corresponding output signal representative of a desired mass ratio of said fluids for each different mode of engine operation, means for sensing one of the fluids supplied to the engine and generating a pulsatory electrical signal whose pulse repetition rate characteristic varies with the volumetric flow rate thereof, means for sensing the other of the fluids supplied to the engine and generating a pulsatory electrical signal whose pulse repetition rate characteristic varies with the volumetric flow rate thereof, means for modifying a pulse characteristic of one of said pulsatory fluid flow signals in accordance with a function of a desired mass fluid ratio representative signal from said mass fluid ratio scheduling means for a corresponding mode of engine operation, correction means for additionally modifying a pulse characteristic of one of said pulsatory fluid flow signals in accordance with at least one ambient parameter of said set of ambient parameters and control means responsive to and electrically combining said fluid flow signals as modified by said scheduled mass fluid ratio signal and by said correction means for controlling the mass flow of said first fluid relative to said second fluid into the engine in accordance with a predetermined relationship between said fluid flow signals that will maintain the actual mass flow of said first fluid supplied to the engine relative to the said second fluid ingested thereby in correspondence with the desired mass fluid ratio scheduled by said mass fluid ratio scheduling means for each different mode of engine operation.

* * * * *